United States Patent [19]

Portmann et al.

[11] 3,967,081

[45] June 29, 1976

[54] SNAP SWITCH

[75] Inventors: Albert Portmann, Murten; Jean-Claude Papaux, Fribourg, both of Switzerland

[73] Assignee: Sodeco-Saia S.A., Geneva, Switzerland

[22] Filed: July 25, 1974

[21] Appl. No.: 491,932

[30] Foreign Application Priority Data

Aug. 16, 1973 Germany ..... 2341488

[52] U.S. Cl. ..... 200/67 PK; 200/76

[51] Int. Cl.[2] ..... H01H 13/28

[58] Field of Search ..... 200/76, 77, DIG. 42, 200/67 PK

[56] References Cited

UNITED STATES PATENTS

| | | | |
|---|---|---|---|
| 1,799,099 | 3/1931 | Johnson | 200/67 PK |
| 3,290,470 | 12/1966 | Sewell | 200/67 PK |

FOREIGN PATENTS OR APPLICATIONS

| | | | |
|---|---|---|---|
| 1,935,225 | 2/1971 | Germany | 200/76 |
| 570,280 | 12/1957 | Italy | 200/76 |

*Primary Examiner*—David Smith, Jr.

*Attorney, Agent, or Firm*—Imirie, Smiley & Linn

[57] ABSTRACT

A snap or toggle switch having two sets of fixed contacts with a bridge normally resting across one pair of contacts but traversing toggle-fashion to the other pair of contacts when an actuating member is depressed. Toggle springs extend from the actuating member to the bridge, both the said member and bridge being flat and extending at right angles to one another. The actuating member operates a lever which forcibly separates fused contacts.

6 Claims, 4 Drawing Figures

SNAP SWITCH

The invention relates to a snap switch having a contact bridge which by means of springs acting between the bridge and an actuating member, jumps over from one switch position through a dead-centre position into another switch position. The switch has a force-locking lever drive for separating fused contacts, and the springs and the lever drive are located within two shanks of a frame-like actuating member.

In one type of known switch (DGbm 1 954 449) the springs the levers and the frame-like actuating member are co-planar with the switching bridge. This is possible only if the whole switching mechanism including the actuating member, springs and levers is located outside the contact space, and the switching movement is transmitted by a rod from the mechanism to the switching bridge. This known embodiment requires a considerable amount of space.

It is an object of the present invention to provide a simple switch structure in which the contacts and the switching mechanism may be telescoped one into the other and thus economise in space.

According to the present invention there is provided a snap switch having a contact bridge which, subject to the action of springs acting between it and an actuating member, jumps from one switch position through a dead-centre position into another switch position, and also having a force lever drive for separating fused contacts, with the springs and the lever drive located within the two sides of a frame-like actuating member, wherein the contact bridge and the frame-like actuating member are at right angles to one another.

It is also known to cause the springs and the levers for separating fused contacts to act directly on the switching bridge (DAS 1 935 225). In this case an actuating ram projects through an aperture of the contact bridge and the levers engage close to the outer ends of the contact bridge. In each case two symmetrically arranged levers are required. In the switch in accordance with the invention, where no actuating ram passes through the centre of the contact bridge, the lever force can engage the centre of the contact bridge, so that only one lever is needed. It has also proved advisable to apply the force required for tearing apart fused contacts, to the centre of the contact bridge. Usually only one contact is fused. A separating force applied to the centre of the contact bridge therefore first of all causes the contact bridge to tip about the fusing point, the other contact of the bridge which is not fused, moving freely; as a result the fused joint is not actually torn apart, but is twisted loose, this requiring considerably less force.

Figure 1:
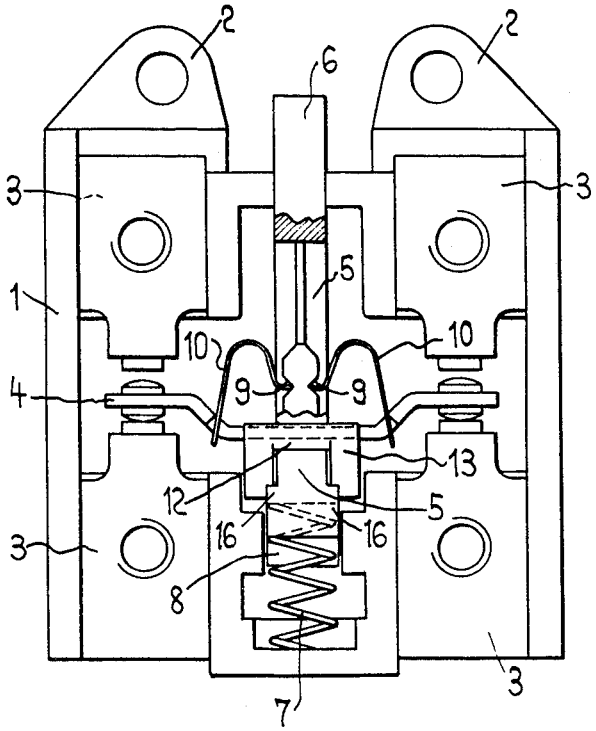

The invention will be described in detail by way of an embodiment of the snap switch shown in the accompanying drawings, in which:

FIG. 1 shows a side view of the switch in an open position

Figure 2:
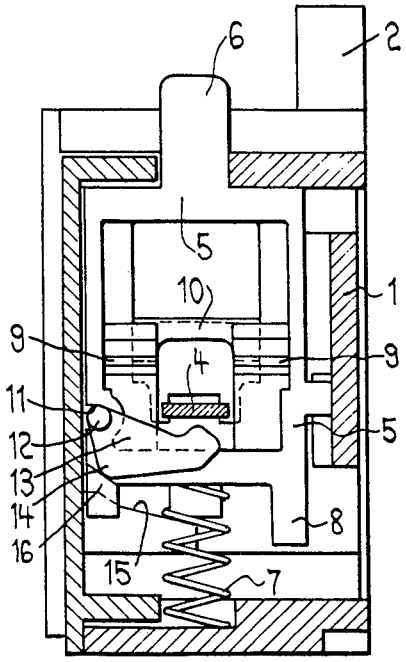
Figure 3:
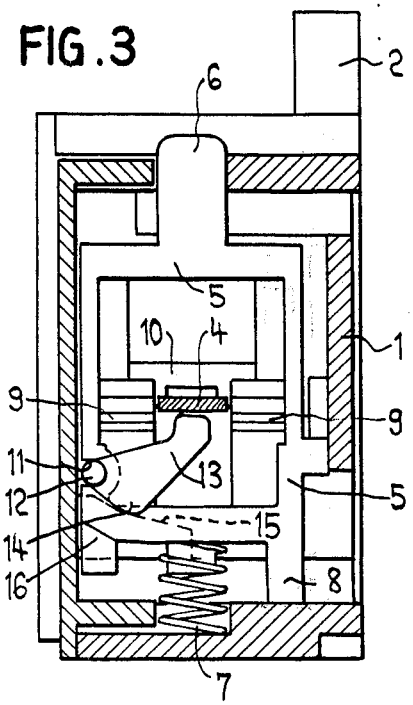
Figure 4:
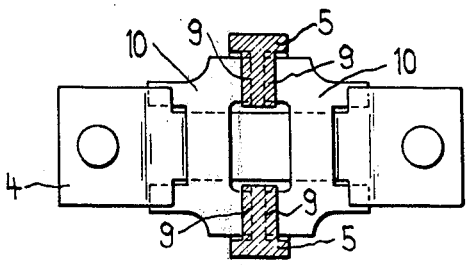

FIGS. 2 and 3 each show a section through the switch at different switching positions, and FIG. 4 shows a plan view of the contact bridge and switching springs.

The switch housing 1 is provided with securing eyelets 2 and has four fixed contacts 3 inserted therein between which there is a switching bridge 4. A frame-shaped actuating member 5 having an actuating knob 6 projecting from the housing is mounted in the housing

1 so as to be displaceable therein. The rest of inoperative position of the bridge is determined by a return spring 7 which urges an actuating member 5 against the upper wall. The working or closed position shown in FIG. 3 is determined by abutment of an extension 8 of the actuating member against the lower housing wall. In the two sides of the switching member there are knife-edge bearings 9 which receive ends of toggle springs 10. The other ends of the switching springs 9 are supported on edges of the contact bridge 4. One side of the actuating member 6 has a bearing recess 11 formed externally therein in which the pivot 12 of a one-armed lever 13 engages. The free end of the lever 13 is retained in the inoperative position shown in FIG. 2 by an abutment 16 which engages beneath the contact bridge 4. A projection 14 of the lever 13 is located adjacent an inclined cam surface 15 of the housing, the surface having an outer steeper and an inner shallower section.

Usually the contact bridge 4 is actuated exclusively by the springs 10. In the inoperative position shown in FIG. 1 the springs 10 retain the contact bridge in its lower position and urge it with adequate pressure against the lower contacts 3. If, the actuating member 5 is downwardly displaced by depressing the knob 6, then the springs 10 are first compressed. When the knife-edge bearings 9 reach a position below the engagement points of the springs 10 on the contact bridge, the contact bridge springs across the rest against the upper contacts 3. A corresponding jump occurs in a reverse direction when the released actuating member again moves upwards under the action of the spring 7. During the downward movement of the actuating member 5 followed by the lever 13, its projection 14 strikes against the surface 15 so that the lever finally assumes the end position shown in FIG. 3 without, however, making contact with the normally actuated contact bridge. If however, the switching bridge 4 contacts have fused with the lower contacts 3, then the normal change-over under the action of the springs 10 does not occur, and the lever then strikes from below against the contact bridge and separates the fused parts. As already stated, the lever 13 by engaging the contact bridge in the centre, pivots the contact bridge about a fused contact, the contact not fused moving freely, so that the fused contact is so weakened by twisting that separation is readily effected. In the exceptional case of both ends of the contact bridge having fused, then the pressure of the lever 13 acting on the bridge centre causes it to bend, so that as before the welded contacts are twisted before being separated.

The inclination of the parts of the cam surface 15 is such that after the lever 13 has struck against this surface, only vertical and inwardly directed force components act on the lever. The effective forces retain the lever in its mounting 11, and the lever 13 is secured against dropping out of its mounting by the housing wall.

We claim:

1. A snap switch comprising a body, fixed contacts on said body, a contact bridge, an actuating member including a frame portion having an opening, said contact bridge being centrally disposed in said opening, toggle springs acting between said bridge and said actuating member so that said bridge jumps from a position in contact with the contacts through a dead-center position to another position spaced from said contacts in response to movement of said actuating member, and force lever drive means responsive to movement of said actuating member for separating said bridge from said contacts, said force lever drive means being disposed for engagement of said contact bridge at a central position thereof.

2. A switch as recited in claim 1, wherein said frame portion of said actuating member is generally planar, and wherein said contact bridge is disposed in said opening of said planar frame portion of substantially a right angle with respect thereto.

3. A switch as recited in claim 1, wherein said force lever drive means includes a single lever, one end of said lever being pivotably mounted in said actuating member whilst the other end of said lever engages the centre of said contact bridge.

4. A switch as recited in claim 3, including a pivot for said lever, said pivot loosely engaging in a recess defined on the outer surface of said actuating member.

5. A switch as recited in claim 3, including an inclined cam surface on said housing adapted to act on said lever to pivot said lever towards said contact bridge.

6. A switch as recited in claim 1, wherein said springs are H-shaped, and each of said springs has two ends resting in knife-edge bearings defined on said actuating lever, and two other ends engaging shoulders on said contact bridge.

* * * * *